US005481816A

United States Patent [19]

Cobb et al.

[11] Patent Number: 5,481,816

[45] Date of Patent: Jan. 9, 1996

[54] MESSAGE SIGN WITH CHANGEABLE DISPLAY

[75] Inventors: Jeffrey B. Cobb, Atlanta; Jerry L. Kilgore, Lilburn, both of Ga.

[73] Assignee: APCO Graphics, Inc., Atlanta, Ga.

[21] Appl. No.: 132,640

[22] Filed: Oct. 6, 1993

[51] Int. Cl.[6] ..... G09F 3/04

[52] U.S. Cl. ..... 40/450; 40/449

[58] Field of Search ..... 40/450, 447, 449

[56] References Cited

U.S. PATENT DOCUMENTS

| | | | |
|---|---|---|---|
| 4,220,948 | 9/1980 | Trame | 40/450 X |
| 4,446,640 | 5/1984 | Kenney | 40/615 X |
| 4,507,888 | 4/1985 | Robinson et al. | 40/450 X |
| 4,539,768 | 9/1985 | Halliday | 40/450 X |
| 4,729,184 | 3/1988 | Cihanek | 40/447 |

*Primary Examiner*—Brian K. Green
*Assistant Examiner*—Cassandra Davis
*Attorney, Agent, or Firm*—Jones & Askew

[57] ABSTRACT

A sign displaying characters in a manner emulating a digital display, in that the characters are formed using character elements to define parts of a particular font of characters. However, unlike a digital character that uses electrical control to activate character elements making up particular characters in the font, the present sign defines particular characters by covering the character elements not required for that character. The digital characters are formed on one or more sign inserts that removably fit within a sign body. The sign body includes a window exposing to view the character elements of each insert. The sign inserts may be of ferrous material and the cover members of magnetic material attachable to the inserts, so that the cover members are readily repositionable to change the message displayed by the digital characters.

4 Claims, 2 Drawing Sheets

MESSAGE SIGN WITH CHANGEABLE DISPLAY

FIELD OF THE INVENTION

This invention relates in general to message signs, and in particular to signs having a selectively changeable alpha or numeric display.

BACKGROUND OF THE INVENTION

Signs are used in many applications where the message or information is expected to change from time to time, so that the information to be displayed by the sign also must change. Changeable-message signs are particularly useful to display numeric information that is anticipated to vary from time to time. Signs utilized to display numeric information, such as currency exchange rates or rates of interest on financial instruments, are but two examples of changeable-message signs. Because numeric information of those kinds is expected to undergo frequent if irregular changes, signs used to display that numeric information to customers or others should permit easy and prompt changing of the displayed numeric information.

Various kinds of changeable-message signs are known in the art. For example, there are signs that support individual alpha or numeric characters applied from a font of type provided for that purpose. The desired message is composed by selecting individual characters from the font and placing those characters on the sign, typically on a sign panel or other member specially designed to retain those characters in a horizontal or other particular alignment. The message, whether numeric or alphabetic, thus is made up of the individual characters selected from the font. The need for a separate font of individual removable characters is, however, a disadvantage of such signs. The individual characters making up the font should be stored in separate individual compartments when not attached to the sign, so that specific characters are easily located when needed to compile a new message. The characters removed from a former message must, accordingly, be placed in their proper compartments, to prevent time-wasting confusion when those characters are later needed. Furthermore, the individual characters making up the font are likely to become lost over time or damaged through frequent handling as the characters are attached to and removed from the sign. Further yet, some skill may be necessary in placing individual characters on the sign panel with the exact proper alignment, to assure that the resulting message has an attractive and professional appearance providing a positive image of the organization sponsoring the message.

Another known kind of sign uses electronic displays to produce selectively variable numeric or alphabetic information. Those electronic displays usually operate by activating selected elements in a matrix of display elements. Each character of an available font is produced by activating only those matrix elements required to define that character, in a manner similar to the digital displays found on many calculators and timepieces. Such electronic display signs are best suited for displaying information that may change from minute to minute, such as financial information at a stock brokerage, but the relatively high cost of those signs makes them impractical for applications where the displayed information may change, at the most, one or two times each day.

Accordingly, it is an object of the present invention to provide an improved changeable message sign.

It is another object of the present invention to provide a changeable message sign that does not require a font of removable individual characters.

It is a further object of the present invention to provide a changeable message sign that is relatively inexpensive to manufacture.

It is yet another object of the present invention to provide a changeable message sign in which the message characters are easily changed to produce the desired characters.

Other objects and advantages of the present invention will become apparent from the following discussion.

Stated in somewhat general terms, the message sign of the present invention displays characters in a manner emulating a digital display, in that the characters are formed using character elements to define parts of a particular font of characters. However, unlike a digital character that uses electrical control to activate the selected character elements making up particular characters by covering the character elements not required for that character.

State with somewhat greater detail, the digital characters are formed on one or more sign panels carried by a sign body to display at least a portion of the panel. The sign panel carries at least one set of character elements that are mutually interrelated to define a predetermined group of indicia. Selected ones of those character elements may be covered in any one of several different patterns, so that only a subset of the character elements remains visible at the display location of the sign body. That subset of character elements corresponds to a certain character selected from the group of characters that the set of character elements can define.

Stated somewhat more particularly, the character elements on the sign panel function in a manner similar to the elements of a digital display. For example, in a preferred embodiment these digital elements form a standard "8" frame, meaning that the elements form that numeral when all elements remain uncovered. By covering selected individual elements of the digital display, other numerals in the set from 0 to 9 are formed, and those numerals become visible to an observer seeing the sign panel. The individual indicia elements making up the digital character may be of the same size, so that the cover members required to cover those indicia elements may likewise be of the same size to the greatest extent possible.

Stated in further detail, a message sign according to the present invention can have a sign panel made of steel or otherwise having a ferrous substrate. The individual cover members in that case are made of any suitable magnetic material so that the cover members are attracted to the ferrous sign panel. Each cover member thus is readily attachable to the sign panel to remain positioned over a selected character element of the character, yet is readily removable when necessary to change the character elements exposed to view. The sign panel and the cover members can be made sufficiently thin so that the sign insert can slidably fit into a channel within the sign body. Once the selected character elements are covered to define the desired arrangement of characters, the sign panel thus is inserted in the sign body and the resulting message becomes resistant to tampering. Moreover, each character of the resulting message has a uniform and attractive appearance that is difficult to obtain with signs whose messages are constructed from a font of removable characters. Because the cover members for the present sign function only to cover the indicia elements and do not themselves bear any visible information, most cover members can be relatively consistent in size and shape, making it easier to store and retrieve those cover members not in use to cover an indicia element.

DETAILED DESCRIPTION OF PREFERRED EMBODIMENT

Figure 2:
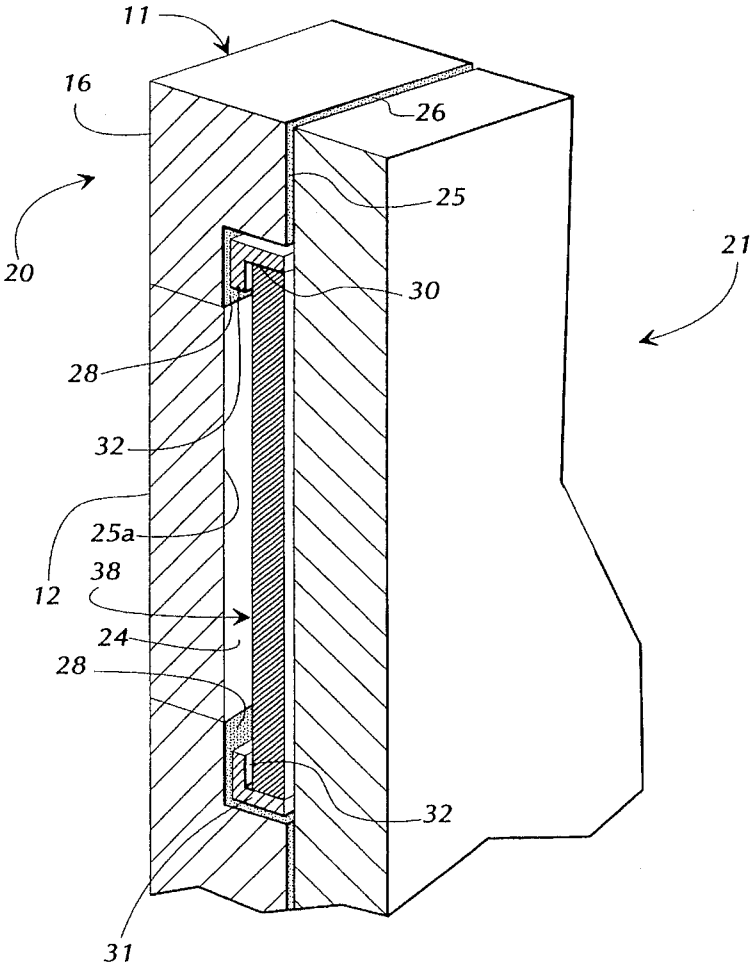
FIG. 2 is a vertical section view of the sign in FIG. 1, shown partially brown away for illustrative purposes.
Figure 1:
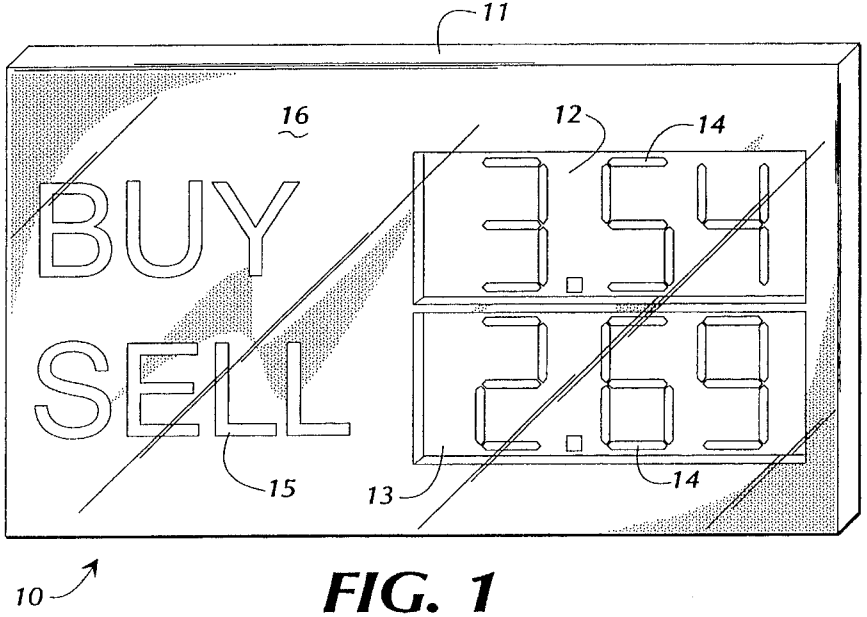
FIG. 1 is a pictorial view showing a changeable message sign according to a preferred embodiment of the present invention.

Turning first to FIGS. 1 and 2, there is shown generally at 10 a message sign according to a preferred embodiment of the present invention. The sign 10 includes a sign body 11 having an overall rectangular shape in the disclosed embodiment, although it will be understood that the overall shape is not critical to the invention. A pair of windows 12 and 13 are defined at the front face 16 of the sign body, and exemplary numeric messages 14 are displayed in those windows. The labels 15 also are visible on the front face 16 of the sign body, in juxtaposition to the respective windows 12 and 13. These labels, which in the disclosed embodiment are manufactured with the sign and thus are not readily changeable, identify the variable information conveyed by the numeric messages 14 in the windows. For example, the labels 15 in FIG. 1 are the words "BUY" and "SELL", referring to the prices, posted in the adjacent windows, at which a person may buy or sell a particular commodity. Alternatively, the labels 15 could identify particular currencies whose exchange rates are posted in the adjacent windows, or the maturity periods of selected financial instruments whose interest rates are posted in the windows.

The construction of the sign body 11 is best seen with regard to FIG. 2. It is there shown that the sign body 11 includes a front plate 20 laminated or otherwise secured to a back plate 21 so that the front plate and back plate in assembly constitute the unitary sign body. The front plate 20 preferably is opaque throughout its area, except for the windows 12 and 13. To that end, the front plate in the preferred embodiment is fabricated from a transparent material such as matte acrylic. A channel 24 is machined or otherwise formed into the back face 25 of the front plate 20, along a portion of the front plate that includes and preferably overlaps one of the windows 12, 13 in the sign body; only one such channel is shown in FIG. 2. Before the front and back plates are laminated together, the back face 25 of the front plate is printed with an opaque background 26 of the color desired for visibility on the front face 16 of the sign body. Prior to printing the background 26 on the front plate 20, the labels 15 are placed on the back face. It should be understood that the background color is not applied to the back face 25*a* in those areas defining the windows 12 and 13 visible at the front face 16 of that plate. The windows thus are defined by the areas of the front plate that are not made opaque by printed on the back face 25 thereof.

The opaque background 26 on the back face of the front panel includes the marginal portions 28 (FIG. 2) extending along the upper and lower edges of the channel 24. The width of each window 12 and 13 thus is somewhat less than the corresponding dimension of the channel 24 behind that window. The purpose of those opaque marginal portions 28 is explained below.

The back plate 21 can be of thickness equal to or slightly greater than that of the front plate 20. The back plate may also be made of acrylic, although transparency is not a requirement of the back plate and other suitable materials may be substituted in its manufacture. Before the back plate 21 is laminated or otherwise fastened to the front plate 20, an upper sign track 30 and a lower sign track 31 are affixed to the front face 32 of the back plate. These tracks 30 and 31 are positioned behind the opaque marginal portions 28 extending beyond the upper and lower sides of the window 12, so that the tracks are not visible to view through the window. Each track 30 and 31 is constructed with a lip 32 spaced in front of the front face 32 of the back plate 21. The lips 32 of the two tracks 30 and 31 extend laterally from the body of each track and face each other, as seen in FIG. 2.

Figure 3:
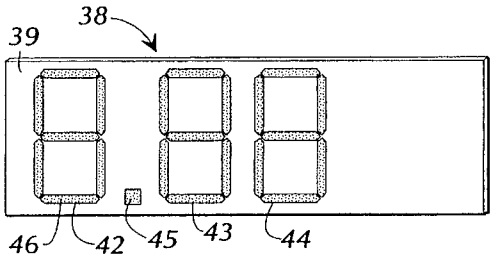
FIG. 3 is a front view of a sign panel insert used in the sign of FIG. 1.
Figure 4:
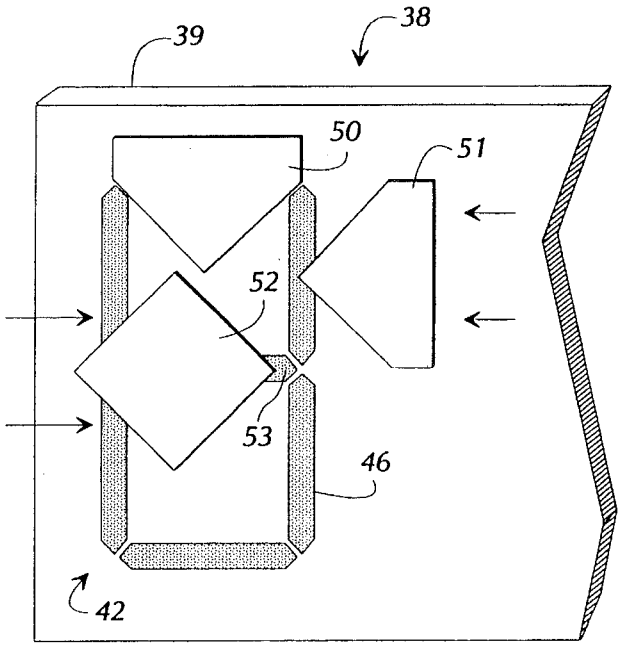
FIG. 4 is a detailed view showing a partially-covered character on the sign panel of FIG. 3.

Each channel 24 in the sign body 11 can receive a separate sign insert 38, and these sign inserts display the numeric messages 14 visible through the windows formed in the sign body 11. A typical sign insert 38 is best seen in FIGS. 3 and 4. The sign inserts 38 in the disclosed embodiment are made of steel or otherwise have a ferrous substrate 39, FIG. 3, and the width of each sign insert is slightly less than the vertical spacing between the tracks 30 and 31 in each channel 24 of the sign body 11. This spacing allows a sign insert to slide through the tracks 30 and 31 supported between the front plate 20 and the back plate 21, within the channel 24 of the sign body. The lips 33 on the tracks 30 and 31 keep the insert from coming in contact with the back face 25*a* of the front plate within the channel 24.

Turning next to FIGS. 3, it is seen that the sign insert 38 in the disclosed embodiment contains three digital characters 42, 43, and 44. The digital characters 42 and 43 are separated near their lower ends by a character 45 representing a decimal point. Each of the digital characters is defined by the seven individual character elements 46. Those character elements each have the shape of an elongated or flattened hexagon, and the character elements are positioned to emulate the appearance of a standard 8-frame digital character of the kind found in LCD digital displays. Each character element 46 making up the digital characters 42–44 preferably have the same shape and dimension.

The character elements 46 making up the digital characters 42–44 are printed directly on the front surface of the substrate 39, after first coating that surface a desired color. The color of the character elements 46 is usually the opposite of, or a high-contrast to, the background color on the sign insert, e.g., white on black, black on white, white on red.

Each 8-frame digital character 42–44 on the sign insert 38 forms the numeral "8" with all the character elements 46 exposed, giving an appearance similar to an actual electrically-actuated digital character when all character elements are actuated. However, unlike conventional digital characters that use electrical signals to produce different characters by turning selected character elements off or on, the digital characters 42–44 cover selected character elements not required to produce the desired character. This is accomplished with individual cover members fabricated of a suitable magnetic material. These cover members are shown in FIG. 4, and include the cover members 50, 51 in the shape of a half-diamond and the diamond-shaped cover member 52. The cover members preferably are fabricated by cutting from a sheet of nonmetallic magnetic material, although cover members made of ferromagnetic metal can be used. The color of each cover member preferably matches the background color on the front surface of the sign insert 38, so that a person viewing the numeric message 14 through a window 12 or 13 of the sign sees no visible distinction between the background of the sign insert and any cover members placed over particular character elements 46 on the sign insert.

The cover members are symmetrically designed to fit around the digital structure of the character elements 46–48 so that selected character elements 46 can be blocked off to form different characters. For example, the cover members 50 and 51 are identical, each having approximately the shape of a half-diamond with an elongated base so the half-diamond portions of those cover members can cover any one of the six character elements 46 around the periphery of the 8-frame digital character 42, without covering any part of an adjacent character element. The cover member 52, however, has a full-diamond shape so as to fit over and cover the central character element 53 of the digital character 42 without covering any part of the character elements 46 adjacent the ends of the central character element.

It should now be apparent that any numeric character from "0" to "9" can be formed by covering the appropriate character elements 46 making up the digital character 42. For example, the character "6" is formed by covering the top and upper-right character elements 46 with two cover members 50 and 51. Once those two character elements are covered, the remaining character elements produce the appearance of a digital "6". Those skilled in the art will understand how the remaining numerals are produced by appropriate covering and uncovering of individual character elements. (The character "8" is, of course, produced by leaving all the character elements uncovered.)

Figure 5:
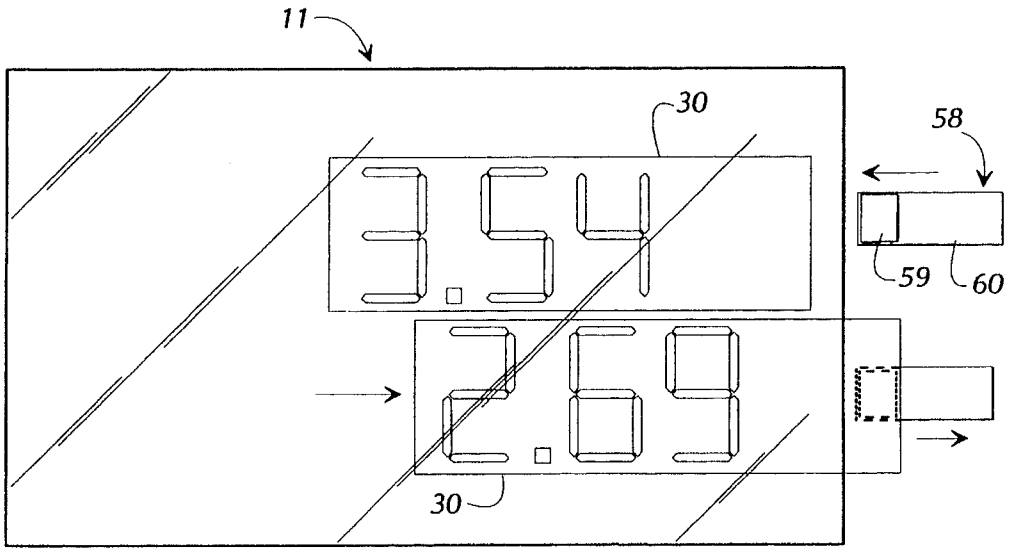
FIG. 5 is a schematic view illustrating the removal of sign panels from the sign of FIG. 1.

A particular numeric message is composed on the present message sign by sliding the desired sign insert 38 out of the channel formed between the upper track 30 and lower track 31 attached to the back plate 21 of the sign body. Removal of a sign insert is facilitated by using the insert removal tool 58, FIG. 5, comprising a magnetic tab 59 disposed at one end of a nonmagnetic handle 60. The insert removal tool 58 is inserted into the channel 38 at one end of the sign body, so that the magnetic tab 59 becomes attracted to the metallic sign insert 38. The sign insert then is withdrawn from the sign body as the tool 58 is manually pulled away from the sign body. With the sign insert 38 removed from the sign body, cover members are placed over or removed from appropriate ones of the character elements 46 making up each digital character 42–44 printed on the sign insert. Once the appropriate numeric message is produced in that manner, the sign insert 38 is returned to the sign body 11 by sliding the insert between the upper and lower tracks 30, 31 until the numeric message is properly positioned in the window 12 or 13 of the sign body. Any unused portion of the sign insert, i.e., portions not visible through the windows in the sign body, provide a convenient place to store disused cover members, so that the cover members always remain available for use when the sign insert is removed from the sign body.

The resulting numeric message, as seen in FIG. 1, has an attractive and professionally-produced appearance, emulating the look of a conventional electrically-produced display. Because the character elements 46 are printed or otherwise permanently formed on each sign insert, those character elements always remain in proper horizontal/vertical alignment, so that the appearance of the displayed message does not depend on the manual dexterity or skills of the person who prepares the message (apart from the minimal ability needed to position each cover member so as to completely cover the selected character elements). Furthermore, the numeric messages 14 are relatively tamper-resistant because each message is encased within the sign body 11, unlike those prior-art signs where individual font characters remain exposed to the touch after attachment to a substrate panel.

Although the disclosed embodiment uses digital characters 42 intended for forming numeric characters, signs according to the present invention are not so limited. Alternatively, one or more of the disclosed digital characters can be replaced by digital characters having character elements necessary for forming alpha or alphanumeric characters. With that modification, it may be necessary to adapt the shape or size of some cover members as necessary to cover the added or different character elements.

While the cover members 50–52 of the present embodiment are magnetically attached to the ferrous sign inserts 38, other means may be employed for removably attaching cover members to a sign insert. For example, cover members may be coated on one side with a suitable contact adhesive that adhers the cover member to the surface of the sign insert, yet permits ready removal of the cover member without leaving a visible residue of adhesive on the previously-covered character elements on the sign insert. As a further alternative, the cover members may be produced from a suitable known kind of plastic material that relies on static electricity to cling to the sign insert.

It should be apparent that the foregoing relates only to a preferred embodiment of the present invention, and that numerous changes and modifications thereof may be made without departing from the spirit and scope of the invention as defined in the following claims.

What is claimed is:

1. A message sign having a changeable display, comprising:

a sign body having a display location of a predetermined area;

a sign panel being insertable in the display location of the sign body and including at least one set of character elements that are operatively interrelated to selectively define a predetermined group of characters;

a plurality of separate members each operative to cover at least a selected one of the character elements in the set with the sign panel in the display location;

at least some of the members having a half-diamond portion to cover a selected one of said set of character elements when the member is placed thereon, and having an elongated base extending from the half-diamond portion, so that the member can cover a character element without covering part of an adjacent character element, so that only a subset of the character elements corresponding to a certain character from the group of characters remains visible to display a character at the display location; and the sign panel has a planar surface of area greater than the area of the display location associated with the sign body so that a predetermined part of the surface area is not visible to view at the display location with the sign panel inserted at the display location, whereby the predetermined part of the surface area constitutes a storage location onto which unused ones of the plurality of separate members may be stored for future use without being visible through the display location.

2. A message sign having a changeable display, comprising:

a sign body having a display location of predetermined area;

a sign panel being insertable in the display location of the sign body and including at least one set of character elements that are operatively interrelated to selectively define a predetermined group of digits;

the set of character elements, is operatively interrelated to form the digit "8" when all elements are visible;

at least one cover member selectively operative to cover at least a selected individual character element of said set of character elements with the sign panel in the display location, so that only a subset of the set of said character elements corresponding to a selected digit remains visible at the display location; and the sign panel comprises a planar surface of area greater than the area of the display location associated with the sign body so that a predetermined part of the surface area is not visible to view at the display location with the sign panel inserted at the display location, whereby the predetermined part of the surface area constitutes a storage location onto which unused ones of the at least one member may be stored for future use without being visible through the display location.

3. A message sign having a changeable display, comprising:

a sign body having a display location of a predetermined area;

a sign panel insertable in the display location of the sign body and including at least one set of character elements that are operatively interrelated to selectively define a predetermined group of characters;

means selectively operative to cover at least a selected one of the character elements in the set of character elements with the sign panel in the display location, so that only a subset of the character elements corresponding to a certain character from the group of characters remains visible at the display location;

the means comprising plural members for covering the character elements; and the sign panel comprising a planar surface of area greater than the area of the display location associated with the sign body so that a predetermined part of the surface area is not visible to view at the display location with the sign panel inserted at the display location, whereby the predetermined part of the surface area constitutes a storage location onto which unused ones of the plural members can be stored for future use without being visible through the display location.

4. The sign as in claim 3, wherein:

the sign panel comprises a ferrous substrate; and the members are magnetized so as to removably attach to the substrate.

* * * * *